United States Patent [19]

Haab

[11] Patent Number: 4,548,293

[45] Date of Patent: Oct. 22, 1985

[54] BIN LADDER CONSTRUCTION

[75] Inventor: Alvin D. Haab, Milford, Ind.

[73] Assignee: Brock Manufacturing, Inc., Milford, Ind.

[21] Appl. No.: 630,751

[22] Filed: Jul. 13, 1984

[51] Int. Cl.[4] ..... E06C 9/02

[52] U.S. Cl. ..... 182/99; 182/106; 182/178

[58] Field of Search ..... 182/99, 106, 178, 194, 182/93

[56] References Cited

U.S. PATENT DOCUMENTS

| | | | |
|---|---|---|---|
| 368,396 | 8/1887 | Hibach | 182/99 |
| 712,504 | 11/1902 | Covert | 182/99 |
| 714,753 | 12/1902 | Siteman | 182/99 |
| 836,785 | 11/1906 | Shumaker | 182/99 |
| 1,157,602 | 10/1915 | Trimyer | 182/99 |
| 1,206,049 | 11/1916 | Tank | 182/99 |
| 1,942,210 | 1/1934 | Harting | 182/27 |
| 3,792,750 | 2/1974 | Madison | 182/106 |

*Primary Examiner*—Reinaldo Machado
*Attorney, Agent, or Firm*—Trexler, Bushnell & Wolters, Ltd.

[57] ABSTRACT

A bin ladder construction includes a vertical ladder up the side of a grain storage bin and an inclined ladder from the upper end of the vertical ladder to the peak of the roof of the grain storage bin. Corner pieces of particular shape and configuration interconnect the inclined and vertical ladders. The ladders have hollow rungs open at both ends, and channel members extend through and beyond the ends of a pair of hollow rungs in the vertical ladder and in the inclined ladder. Triangular brackets mount the opposite ends of hand rails to the ends of said channels.

11 Claims, 7 Drawing Figures

BIN LADDER CONSTRUCTION

BACKGROUND OF THE INVENTION

Grain is often stored on farms or in farming country in bins. Such bins are typically manufactured of metal, and are mainly of a cylindrical construction, but having a tapered, frustoconical lower portion for gravitational discharge of the grain, and further having a frustoconical top with an opening therein covered by a lid for transferring grain into the bin. It is frequently necessary to have access to the upper opening of the bin for purposes of manually removing the lid therefrom, for positioning a chute to feed grain thereinto, or for visual inspection of the interior of the bin to ascertain the degree to which it is filled, and that the grain is in good condition.

It therefore is necessary to provide a ladder up the side of the bin, and diagonally across the upper frustoconical portion or roof. A hand rail is typically provided at the top of the vertical portion of the ladder and extending over the inclined portion. Since the hand rails extend a significant distance above the inclined portion of the ladder substantial lateral leverage can be applied inadvertently. As will be understood, deformation or collapse of the hand rails cannot be tolerated as it could cause a person on the ladder to fall, leading to serious injury or death. Furthermore, the juncture between the vertical ladder portion and the inclined portion in the past has been a weak area structurally, and further has sometimes caused problems of clothing snagging thereon. The upper end of the inclined portion also has been known to cause snagging of clothing.

OBJECTS AND SUMMARY OF THE PRESENT INVENTION

It therefore is an object of the present invention to provide a superior hand rail on a bin ladder, particularly one having a superior connection to the ladder.

It further is an object of the present invention to provide a superior joining member between the vertical and inclined portions of the ladder which is of great strength and avoids snagging of clothing.

Yet another object of the present invention is to provide an upper end fitting for the inclined portion of the ladder which avoids snagging of clothing.

In attaining the foregoing and other objects I provide a vertical ladder of substantially conventional construction up the side of a grain bin. The ladder is made of metal, preferably aluminum, and is connected to the bin by brackets which may be of known or conventional construction. A diagonally disposed ladder section is joined at the top of the vertical ladder adjacent the rim of the roof or frustoconical top wall of the bin, the vertical ladder and the diagonal ladder having the side rails thereof interconnected by corner pieces which have center sections fitting between and abutting the ends of the side rails of the vertical and diagonal ladders, and having flanges fitting within the channel shaped side rails. The end pieces have curved lateral flanges which abut the ends of the flanges of the side rails and provide a smooth transition from one hand rail to the other, thereby avoiding any corners on which clothing could catch. Similar corner brackets are used at the upper ends of the diagonal ladder to connect the side rails thereof to mounting brackets on the roof or frustoconical top wall.

The vertical ladder and the diagonal ladder are provided with hollow, generally cylindrical rungs which are open at the ends. Adjacent the upper end of the vertical ladder, and at an intermediate position on the diagonal ladder channels extend through two of the rungs, and are connected by brackets or braces to the ends of the hand rails. The channels distribute the load from the hand rail more uniformly onto the ladder structure, and thereby to provide a stiffer, stronger and safer hand rail construction.

THE DRAWINGS

The present invention will best be understood from the following specification when taken in connection with the accompanying drawings wherein.

DETAILED DISCLOSURE OF THE ILLUSTRATED EMBODIMENT

Figures 1, 2, 3, 3A:
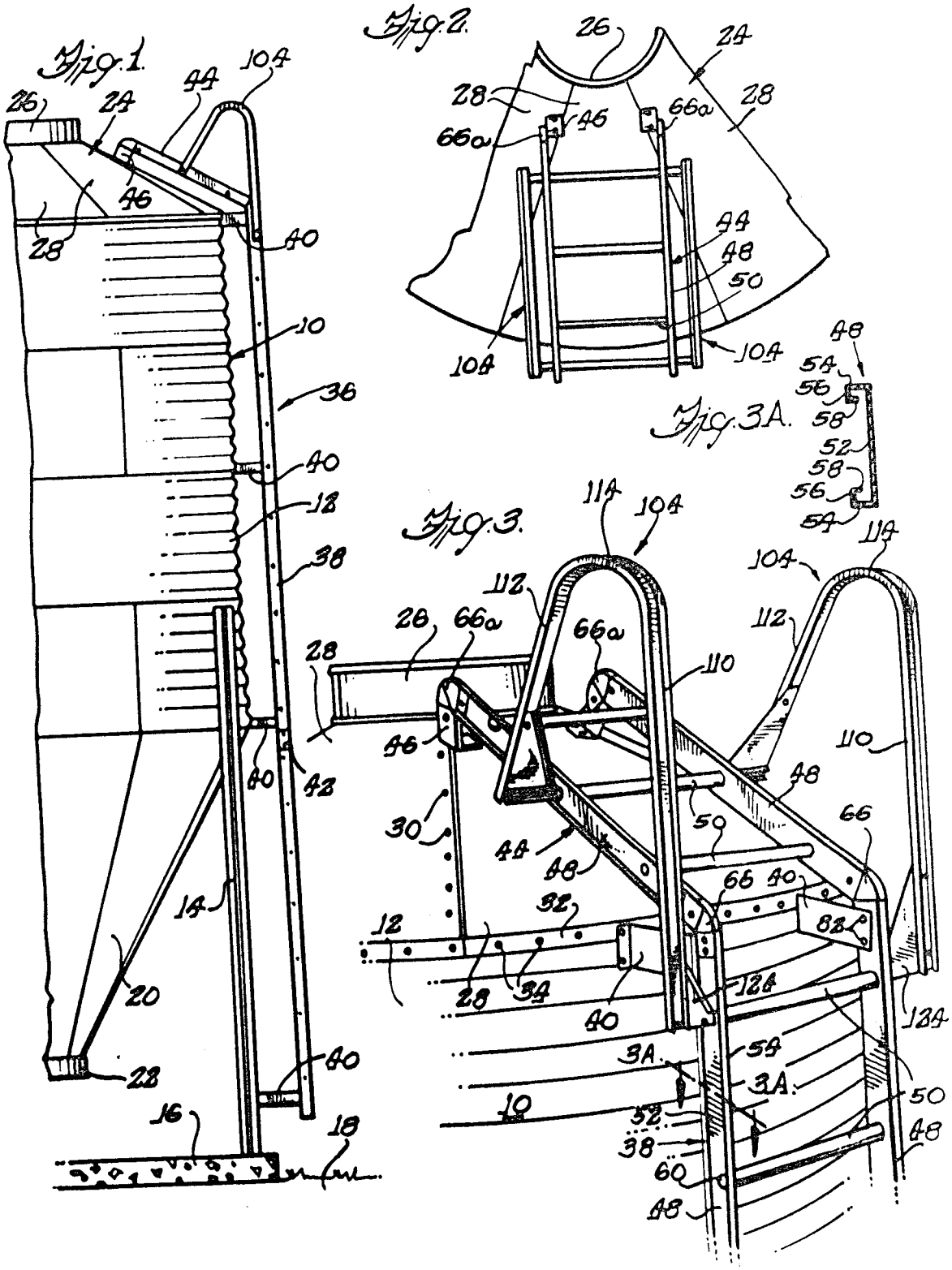
FIG. 1 is a side view of a grain storage bin, shown fragmentarily, with a vertical ladder up the side and a diagonal ladder over the roof thereof, incorporating the principles of the present invention.
FIG. 2 is a fragmentary top view of the bin and the diagonal ladder on an enlarged scale.
FIG. 3 is a perspective view showing the upper portion of the bin, the upper portion of the vertical ladder, all of the diagonal ladder, and the hand rails.
FIG. 3A is a cross-section through a ladder side rail as taken substantially along the line 3A—3A in FIG. 3.

Turning now to the drawings in greater particularity, the present bin ladder construction is shown generally and in combination with a bin in FIG. 1. The bin 10 is of generally conventional construction, and is formed of sections of sheet metal bolted together to form a generally cylindrical body 12. The sheet metal preferably is corrugated for strength and rigidity. Depending legs or supports 14 extend down from the body 12 to a concrete slab 16 which preferably has a foundation (not shown) extending down into the ground 18.

The bin is provided at the bottom of the body 12 with an inwardly tapered frustoconical bottom wall 20 formed of substantially triangular sections of sheet metal bolted together, and leading to a bottom discharge opening 22 which is normally closed by a valve or gate of conventional construction, and which is opened to permit gravitational flow of grain from the bin when desired.

The bin 10 is provided at the upper end of the body with a frustoconical roof or top wall 24 tapering upwardly and inwardly to an upper rim 26 forming an opening into the bin through which grain may be loaded. The rim 26 and upper opening are normally closed by a lid or cover (not shown) which is hinged in place so that it may be opened to permit entry of grain into the bin 10. The roof 24 is formed of generally trapezoidal sections 28 which are suitably bolted together as indicated at 30. The lower edges of the sections 28 are provided with downturned flanges 32 which are bolted at 34 to the upper edges of the body 12 (FIG. 3).

The bin 10, as previously indicated, is of substantially conventional construction and comprises sections or panels of sheet metal bolted together.

The sheet metal is of any suitable corrosion resisting type such as galvanized steel, stainless steel, aluminum, etc.

The bin ladder construction 36 forming the subject matter of the present invention includes a vertical ladder or ladder section 38 secured to the legs or supports 14 and to the body 12 of the bin by means of brackets 40 which may be of conventional construction. The vertical ladder 38 may comprise a plurality of sections or flights suitably splined and bolted together as indicated at 42. The bin ladder construction 36 further includes a diagonal ladder 44 secured to the upper end of the vertical ladder 38 as will be disclosed hereinafter, and mounted to the roof 28 by means including brackets 46 as also will be discussed further hereinafter.

The vertical ladder 38 and the inclined roof ladder 44 are of similar construction, and each includes a pair of side rails 48 and interconnecting hollow rungs 50. Each side rail 48 as best may be seen in FIG. 3A is of generally channel shape and includes a web 52 and right angularly disposed edge flanges 54. The edge flanges 54 are provided with coplanar flanges 56 directed toward one another, and having inwardly directed flanges 58 on the edges thereof, thereby providing a very rigid structure.

Figure 6:
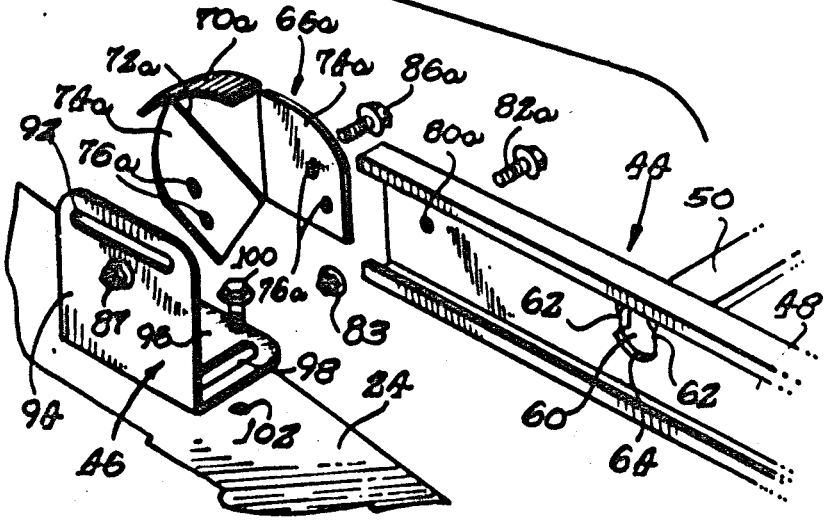
FIG. 6 is an exploded perspective view of the upper end of one side of the upper end of the diagonal roof ladder.

The hollow rungs 50 are cylindrical in nature, and preferably are ribbed for rigidity. The rungs are secured to the side rails 38 by any suitable or known means. This can include radial enlargement of the rungs immediately inboard of the side rail flanges 52, with further enlargements or flanges outboard of the webs 52, the webs being suitably apertured as indicated at 60. Another suitable construction is shown in FIG. 6 in which the aperture is partially circular in nature, but has opposite flat sides 62 against which end portions of the rungs 50 abut, other portions of the rungs fitting through the circular portion of the aperture and being flanged over at 64. This construction is satisfactory when it is realized that the anchored nature of the ladders prevents any side thrust thereon that could cause a bending moment between the juncture of the rungs and the side rails.

The important feature to note is that the rungs 50 are hollow, and are open at the ends through the apertures 60 in the side rails.

An important aspect of the invention resides in the provision of the corner members 66 (FIGS. 3–5) that join the vertical ladders 38 to the inclined roof ladders 44. Each such corner (see especially FIG. 5), includes a web 68 having an arcuate extent of 60 degrees and having at the outer portion thereof a right angular arcuate flange 70. The web 68 further has two radial edges having narrow offsetting flanges 72 in the same direction as the flange 70, and to which are connected flanges 74 having pairs of apertures 76 therein. The upper edge of each flange 74 is arcuate, while the lower or inner edge is straight, as is the remote edge.

The flanges 74 fit within the open ends of the respective side rails 48 of the vertical ladder 34 and the inclined roof ladder 44, the side rails being at 60 degrees to one another. The narrow offset of the flanges 72 is just enough so that with the flanges 74 abutting the inner faces of the rail webs 52 the web 68 of the corner is coplanar with the rail webs 52, the offsetting flanges 72 abutting the ends of the rail webs 52. The bracket 40 mounting the upper end of each vertical ladder rail 48 is provided with a pair of apertures 78 which are aligned with apertures 80 in the upper end of the web 52. Bolts 82 extend through the aligned apertures 78 and 80, and the upper bolt also extends through one of the apertures 76 in the lower flange 74. Nuts (not shown) are threaded onto the opposite ends of the bolts. The lower ends of the webs 52 of the rails 48 of the roof ladder 44 are provided with apertures 84. A bolt 86 passes through each such aperture 84 and through one of the apertures 76 in the upper flange 74, a nut (not shown) being threaded on the opposite ends of each such bolt. Additional holes in the rail webs may be provided so that a second bolt may be passed through each web and through the second of each of the holes 76, a nut again being threaded on the opposite end.

Although not specifically mentioned heretofore, each bracket 40 has a right angle flange 88 on the inner end thereof, through which bolts 90 pass to secure the bracket to the depending flange 32 of the roof and/or the sidewall of the body 12, appropriate nuts being provided on the inner ends of the bolts.

Each corner 66 provides a strong and rigid interconnection between the rails 48 of the vertical ladder 38 and the rails 48 of the roof ladder 44. The flanges 78 fit within the channels of the side rails, acting as splines, while the 60 degree shape of the web coupled with the narrow offsetting flanges 72 causes the ends of the rail webs 52 to but against the narrow flanges 72 with the web 68 coplanar with the webs 52. This produces a strong and rigid structure which is enhanced by the arcuate flange 70 which buts against the ends of the flanges 54 of the side rails. The arcuate flange 70 further provides a smooth transition, eliminating any corners on which clothing might be caught.

The connections or junctions of the upper ends of the side rails 48 of the inclined or roof ladder 44 to the brackets 46 is made by corners 66*a* connected between the rails 48 and the brackets 46. These corners are the same as the corners 66 just described, and to avoid repeating the description similar numerals are used for like parts with the addition of the suffix a. One flange 74*a* lies within the channel of the side rail 48, a bolt 82*a* passing through an aperture 80*a* in the web of the side rail and also through one of the openings 76*a* in the corresponding flange 74*a*, a nut 83 being threaded onto the end of the bolt 82*a*. A bolt 86*a* extends through one of the apertures 76*a* in the other flange 74*a*, through a horizontal slot 92 in an upstanding flange 94 of the bracket 86, a nut 87 being threaded on the end of the bolt 86*a*. The bracket 46 has a second flange 96 at right angles to the flange 94. There are two transverse slots 98 in the flange 96 and bolts 100 extend through these slots and through apertures 102 in the roof 24, thus securely anchoring the upper end of the roof ladder 44. The arcuate flange 70*a* again avoids sharp corners at a location where clothing could catch, while the slots 92 and 98 in the bracket 46 provide for a certain degree of adjustability.

Figure 4:
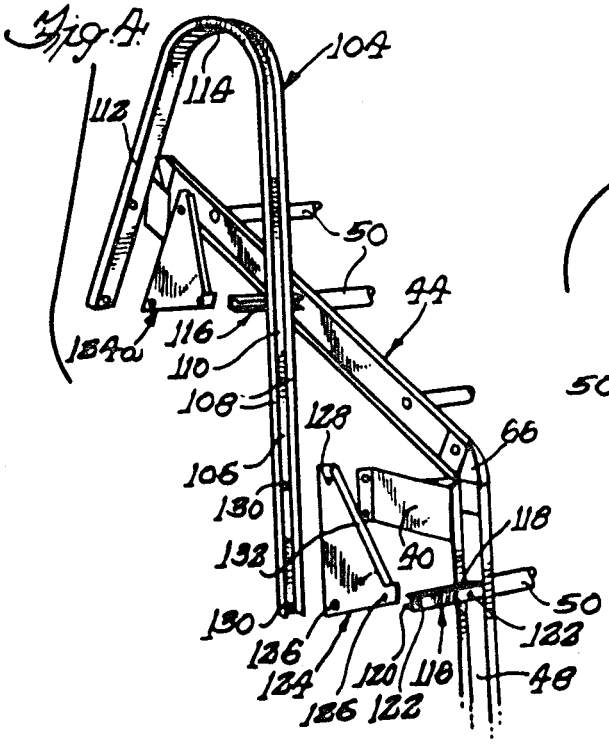
FIG. 4 is an exploded perspective view similar to a portion of FIG. 3.
Figure 5:
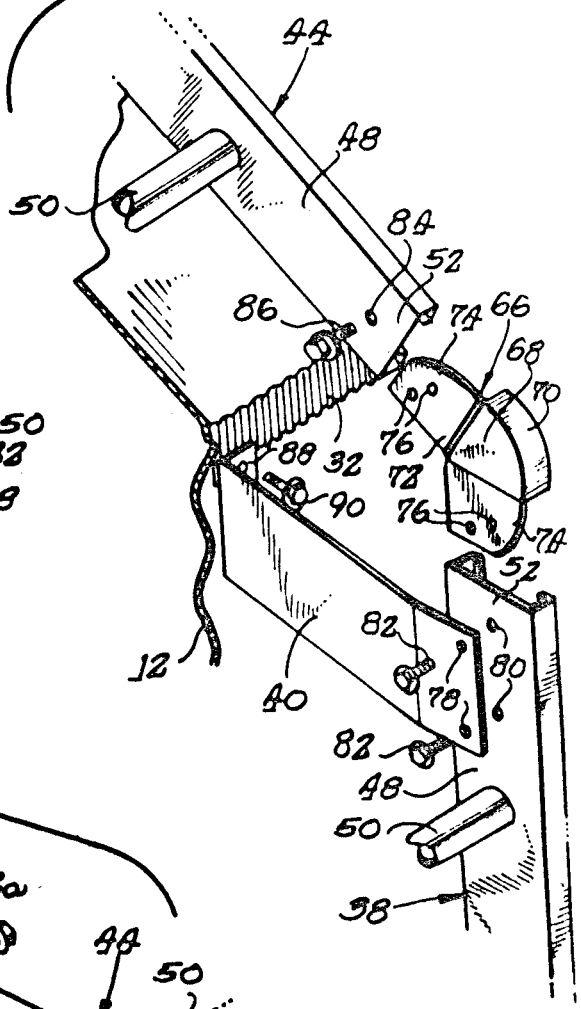
FIG. 5 is a further enlarged and further exploded perspective view of a portion of FIG. 3.

A pair of hand rails 104 is provided at the upper end of the vertical ladder 38 and over the lower portion of the inclined roof ladder 44. Such hand rails comprise channels each having a web 106 and a pair of flanges 108 extending outwardly at right angles therefrom (FIG. 4). Each hand rail includes a vertical portion 110 extending upwardly from adjacent the upper end of a side rail of the vertical ladder 38. Each side rail further includes a diagonal portion 112 extending at a large acute angle nearly perpendicular to the mid point of a side rail 48 of the inclined roof ladder 44. The two respective portions 110 and 112 of each hand rail are interconnected by an arcuate section 114.

The structure by means of which the hand rails are connected to the ladders is important and is believed to be novel. A hand rail channel extends through the uppermost hollow rung 50 of the vertical ladder 38 and extends at either end therefrom. The channel 116 includes a web 118, and a pair of edge flanges 120 extending toward the bin body 12. Two spaced apertures are provided in each extending end of the web 118. A substantially right triangular hand rail brace or gussett 124 is provided along its horizontal lower edge with a pair of apertures 126 which align with the apertures 122 in the hand rail channel. The leftmost (FIG. 4) aperture 126 is adjacent the elongated vertical edge of the brace 124, and there is a vertically aligned aperture 128 in the brace. A pair of similarly spaced apertures 130 is provided in the web 106 of the vertical portion 110 of the hand rail 104. The diagonal side of the brace 124 is rolled over as a flange at 132 for greater strength and rigidity. One bolt passes through the lowermost aperture 130, the leftmost (FIG. 4) of the aperture 126 and the leftmost aperture 122. Another bolt passes through the rightmost apertures 126 and 122, and yet another bolt passes through the aligned apertures 130 and 128. The bottom ends of the vertical portions 110 of the hand rails 104 thus are securely anchored to the hand rail channel 116, extending through the uppermost hollow rung 50 of the vertical ladder 38.

A similar hand rail channel 116*a* passes through the center hollow rung 50 of the inclined roof ladder 44 and extends from the opposite ends thereof. A similar triangular hand rail bracket 124*a* similarly secures the opposite ends of the hand rails 104 to the opposite ends of the channel 116.

The use of the triangular braces and the securement of the ends of the hand rail to the channels running entirely through the hollow rungs distributes the load from the hand rail more uniformly into the ladder structure. The hand rails are thus more securely affixed to the ladder than has been possible with prior art constructions.

The specific example of the bin ladder construction as herein shown and described is for illustrative purposes only. Various changes in structure will no doubt occur to those skilled in the art, and will be understood as forming a part of the present invention insofar as they fall within the spirit and scope of the appended claims.

The invention is claimed as follows:

1. A ladder construction comprising a substantially vertical ladder section and an inclined ladder section, each of said ladder sections comprising a pair of longitudinally extending channel-shaped side rails each having a central web and side flanges, interconnected by a plurality of transversely extending hollow rungs open at both ends, a pair of corner pieces interconnecting said substantially vertical ladder section and said inclined ladder section and each including a planar body section lying coplanar with said ladder rail webs and having extending therefrom a pair of offset flanges lying between respective ladder rail flanges and against respective webs and secured to said rails, a pair of hand rails extending up from said substantially vertical ladder section and overlying said inclined ladder section, and a pair of elongated hand rail mounting members extending through and beyond respective hollow rungs in said substantially vertical ladder section and said inclined ladder section and on which said hand rails are mounted.

2. A ladder construction as set forth in claim 1 and further including a plurality of triangular brackets respectively mounting the ends of said hand rails on the ends of said hand rail mounting members.

3. A ladder construction as set forth in claim 1 and further including a second pair of corner pieces the same as said first mentioned pair of corner pieces, said second pair of corner pieces being secured to the upper ends of said inclined ladder section and to mounting brackets for securing said inclined ladder section.

4. A ladder construction as set forth in claim 2 and further including a second pair of corner pieces the same as said first mentioned pair of corner pieces, said second pair of corner pieces being secured to the upper ends of said inclined ladder section and to mounting brackets for securing said inclined ladder section.

5. A ladder construction as set forth in claim 1 wherein each of said corner pieces further has a curved flange on said planar body section extending in smooth transition between like side rail flanges of said substantially vertical ladder section and said inclined ladder section.

6. A ladder construction as set forth in claim 1 wherein said elongated hand rail mounting members comprise channel-shaped members.

7. A ladder construction as set forth in claim 4 wherein each of said corner pieces has a curved flange on said planar body providing a smooth transition between like flanges on said side rails of said substantially vertical ladder section and said inclined ladder section, and wherein said elongated hand rail mounting members comprise channel-shaped members.

8. A ladder construction comprising a substantially vertical ladder section and an inclined ladder section, each of said ladder sections comprising a pair of longitudinally extending channel-shaped side rails each having a central web and side flanges, interconnected by a plurality of transversely extending rungs, and a pair of corner pieces interconnecting said substantially vertical ladder section and said inclined ladder section and each including a planar body section lying coplanar with said ladder rail webs and having extending therefrom a pair of offset flanges lying between respective ladder rail flanges and against respective webs and secured to said rails.

9. A ladder construction as set forth in claim 8 wherein each of said corner pieces further has a curved flange on said planar body section extending in smooth transition between like side rail flanges of said substantially vertical ladder section and said inclined ladder section.

10. A ladder construction as set forth in claim 8 and further including a second pair of corner pieces the same as said first mentioned pair of corner pieces, said second pair of corner pieces being secured to the upper ends of said inclined ladder section and to mounting brackets for securing said inclined ladder section.

11. A ladder construction as set forth in claim 9 and further including a second pair of corner pieces the same as said first mentioned pair of corner pieces, said second pair of corner pieces being secured to the upper ends of said incined ladder section and to mounting brackets for securing said inclined ladder section.

• • • • •